United States Patent [19]

Dean, II

[11] Patent Number: 4,651,605

[45] Date of Patent: Mar. 24, 1987

[54] DOUBLE BLADE ROTARY CUTTER APPARATUS

[75] Inventor: Walter C. Dean, II, Simsbury, Conn.

[73] Assignee: KCR Technology, Inc., East Hartford, Conn.

[21] Appl. No.: 762,110

[22] Filed: Aug. 2, 1985

[51] Int. Cl.[4] ..... B26D 1/28

[52] U.S. Cl. ..... 83/209; 83/349; 83/583; 83/923

[58] Field of Search ..... 83/349, 209, 583, 582, 83/355, 356.3, 923

[56] References Cited

U.S. PATENT DOCUMENTS 3,799,020 3/1974 Hoelmer ..... 83/349

3,956,954 5/1976 Edwards ..... 83/349 X 4,197,773 4/1980 Kunzmann ..... 83/209

4,244,251 1/1981 Iwao et al. ..... 83/349

4,409,870 10/1983 Rynik et al. ..... 83/349 X

*Primary Examiner*—Donald R. Schran

*Attorney, Agent, or Firm*—Hayes & Reinsmith

[57] ABSTRACT

A double blade rotary paper cutter is disclosed which may be used as an auxiliary unit with a controlled printer unit. The paper cutter features a series of cutting blades which effect the removal of fanfold or perforated portions and carrier strips from fanfold paper and a positional control mechanism to sequentially and precisely position individual strips of fanfold paper within the cutting area of blades of the rotary paper cutter.

5 Claims, 4 Drawing Figures

DOUBLE BLADE ROTARY CUTTER APPARATUS

FIELD OF INVENTION

This invention generally concerns paper handling and cutting apparatus and is specifically directed to a high speed paper cutting apparatus for fanfold paper which removes the thin strip of paper containing the fanfold of such paper.

BACKGROUND OF INVENTION

With the advent of automated office equipment and other high speed information output machines including programmable typewriters, word processors, computers and the like, continuous fanfold or perforated paper has become a fixture in most offices.

Because of the desire for clean edged and ended separate strips or sheets of such paper, paper cutters have been developed which remove the fanfold, holed and perforated ends and edges of the paper. One such known device uses two rotational slitters to remove the carrier strips containing sprocket holes and a single blade rotary cutter to remove the fanfold or perforated portion of paper. However, machines of this type are limited in their usefulness and output because of the maximum rotational speed attainable by the single blade rotary cutter. With such speed restriction, the throughput speed of fanfold paper is limited because the rotating cutter must make extra revolutions at each perforation to make each cut. Such excess rotations consume approximately 60% of process time in moving the paper to the next cut position.

OBJECTS OF THE INVENTION

It is an object of this invention to provide mechanically simple, compact, modular paper cutting apparatus which conforms to the requirements of existing printing equipment and which is economical to manufacturer and assemble.

It is another principal object of the present invention to provide apparatus to remove fold line and/or perforations from continuous paper and eliminate the manual cutting effort required to produce clean cut ends and edges on paper sheets.

Another object is to provide such apparatus in an autonomous form, i.e., in a form where the apparatus functions both mechanically and electrically independent of the printing machine with which it is associated.

Still another object of the present invention is to provide a paper cutting device which provides a double cut per revolution of a rotary cutter, the rotary cutter being in continuous rotation during a controlled feeding and cutting cycle.

Another principal object of the present invention is to provide a paper cutting apparatus which significantly increases the output of properly trimmed individual paper strips or sheets by using a rotary cutter having two blades operating in cooperation with a non-rotatable blade to sever the portion of fanfold paper closely adjacent each fold.

Other objects will in part be obvious and in part pointed out more in detail hereinafter.

SUMMARY OF THE INVENTION

In accordance with this invention, a paper cutting apparatus for use with fanfold paper is provided to substantially increase the output of trimmed clean-edged and ended paper without increasing the rotational speed of the rotating cutter. The cutting apparatus includes a frame, paper sheet engaging feed means mounted on the frame for feeding the paper along a paper feed path and a continuously revolving rotary cutter. The rotary cutter is disposed in the paper feed path for rotation about an axis extending transversely of the paper feed path. The rotary cutter has first and second blades for successively cutting the fanfold paper transversely of its longitudinally extending side edges and closely adjacent opposite sides of each fanfold portion of paper by a single rotation of the rotary cutter.

The cutting apparatus also includes a non-rotatable blade supported on the frame which cooperates with blades of the rotary cutter to sever paper on opposite sides of each fanfold portion and intermittently operable power means for actuating the sheet engaging feed means and for effecting a dwell between movements of the advancing paper.

A better understanding of the objects, advantages, features, properties and relations of this invention will be obtained from the following detailed description and accompanying drawings which set forth an illustrative embodiment and application of the invention and are indicative of the various ways in which the principles of this invention are employed.

DETAILED DESCRIPTION OF A PREFERRED EMBODIMENT

Figure 1:
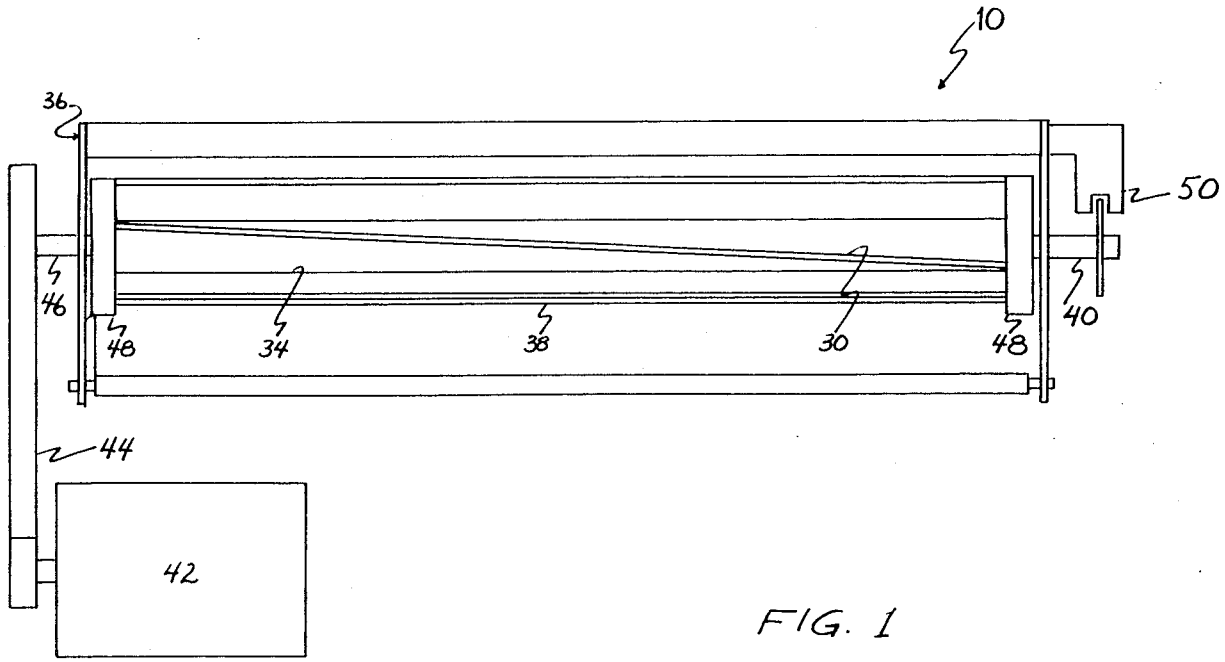
FIG. 1 is a front elevational view of a paper cutting apparatus in accordance with the present invention.

Referring now to the drawings wherein like reference characters represent like elements, there is shown a paper cutting apparatus 10 constructed in accordance with the present invention. The paper cutting apparatus illustrated in FIGS. 1–3 is suited to be mounted adjacent an output end of an impact printer or the like which utilizes continuous fanfold paper or operated independently of such devices from stacks of printed continuous fanfold paper.

Figure 2:
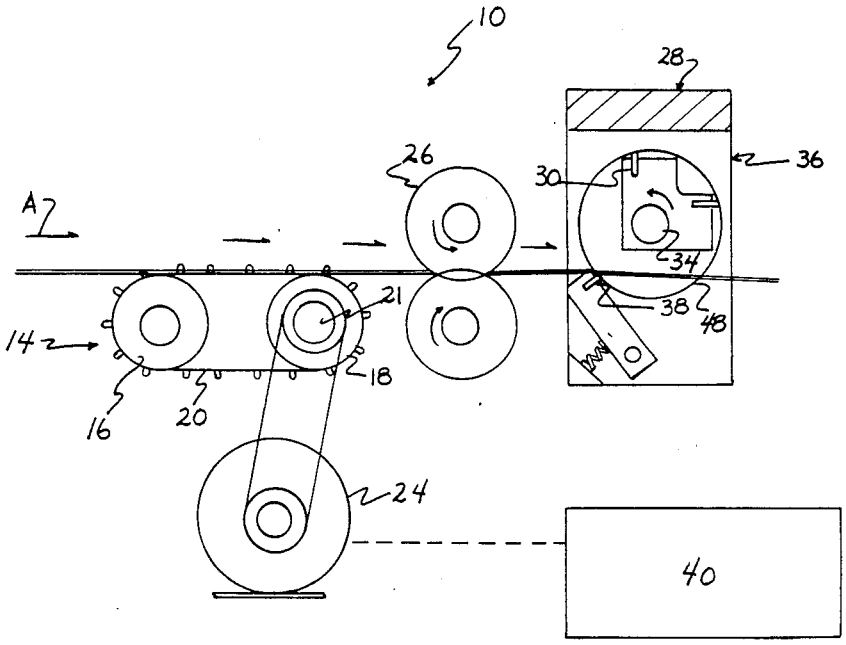
FIG. 2 is a side schematic view of the apparatus of this invention.
Figure 3:
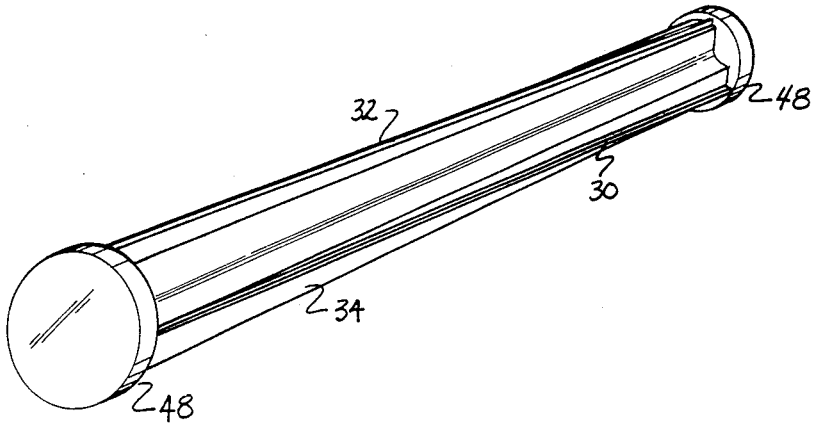
FIG. 3 is a perspective view of the rotary cutter illustrating the helical angle at which the blades of the rotary cutter are disposed.

In accordance with conventional computer printers, strips 12 of continuous fanfold paper exits from a suitable printing apparatus and is fed along a feed path extending in the direction of the longitudinal axis of a strip 12 of fanfold paper (see FIG. 4) in the direction of arrow A in FIG. 2.

To effect paper feed for the apparatus 10, the leading edge of the paper strip 12 is engaged by sheet engaging feed means or feeder 14. Feeder 14 includes a pair of parallel spaced rollers 16 and 18, roller 18 being axially mounted on a transversely extending drive shaft 21 for rotation therewith. Feeder 14 includes a belt 20 containing guide projections for engaging sprocket holes 11 of carrier strips 22 (FIG. 4) of paper strip 12. The drive shaft 21 (FIG. 2) is driven by a conventional power drive 24.

Figure 4:
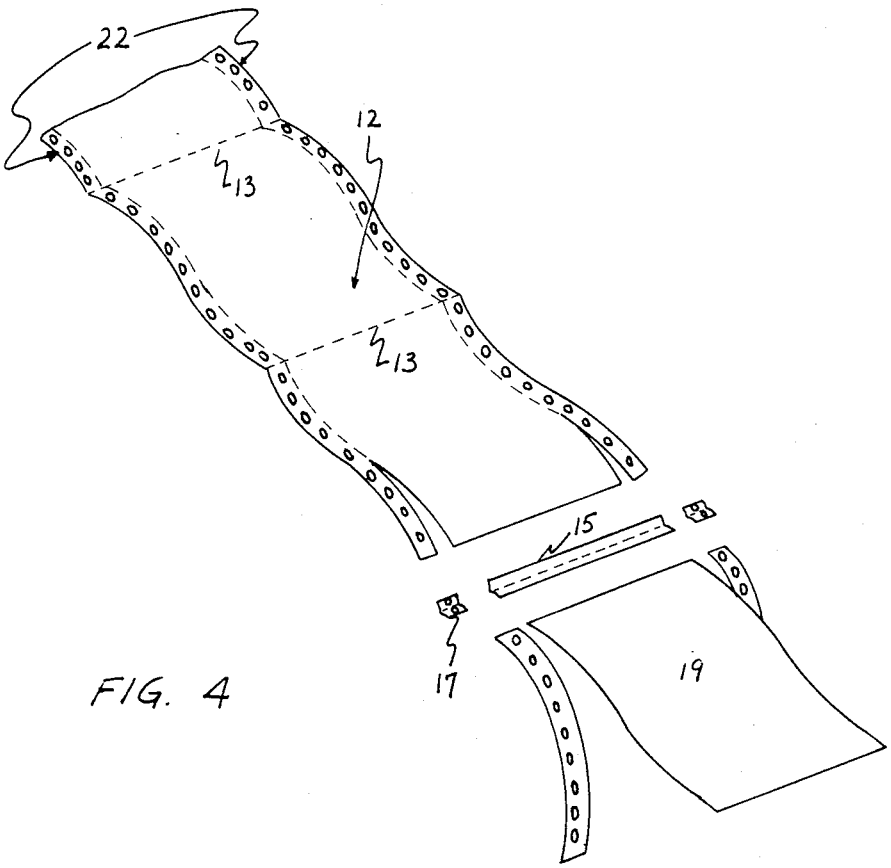
FIG. 4 is a schematic view illustrating the cutting which occurs to a sheet of fanfold paper being passed through the paper cutting apparatus of this invention.

The paper strip 12 is then fed downstream to a slitting means 26 where strip 12 is continuously cut adjacent its longitudinal sides edges containing carrier strips 22, as best seen in FIG. 4, before paper strip 12 is fed to a rotary cutter 28.

To effect significant increase in the output of fanfold paper cutters, and provide significant cost savings associated with such increased output, the rotary cutter 28 of the present invention is provided with two blades 30 and 32 disposed on a carrier bar 34 downstream of the printer (not shown) and sheet engaging feed means 14. A frame 36 supports rotary cutter 28 for rotation about an axis extending transversely of the feed path A.

The blades 30, 32 are positioned at an angle to each other, approximating 90 degrees, on carrier bar 34. Each blade 30, 32 is fixedly mounted on carrier bar 34 to extend in an arcuate path along its length to effect proper cutting action through rotation of cutting blades 30, 32.

A non-rotatable or third blade 38 is supported for pivoting movement on frame 36 and extends transversely of paper strip feed path A to cooperate with blades 30, 32 of rotary cutter 28 for severing paper strip 12 on opposite sides of fanfolds 13. Non-rotatable blade 38 is spring loaded on frame 36 to be biased toward blades 30, 32 for providing cutting engagement with paper strip 12.

In the disclosed construction, rotary movement of cutter 28 is effected by power drive mechanism 42 via a driving member 44, such as a belt or direct drive, to rotary drive shaft 46 which is supported for rotation on the sides of frame 36. The drive mechanism 42 provides a one-way rotary drive in a counter-clockwise direction as viewed in FIG. 2. Cams 48 mounted on opposite ends of carrier bar 34 are engageable with non-rotatable blade 38 for positioning of non-rotatable blade 38 at the start of each cutting cycle after each revolution of rotary cutter 28. During rotation of rotary cutter 28, cams 48 engage non-rotatable blade 38 during a strip advancing, non-cutting portion of each feed cycle to disengage the cooperating rotary cutter 28 and blade 38 and allow paper strip 12 to pass between rotary cutter 28 and blade 38. Upon continuance of counter-clockwise rotation of rotary cutter 28, cams 48 disengage non-rotatable blade 38 to allow movement of blades 30, 32 38 toward rotary blade to thereby position non-rotatable blade 38 in cutting engagement with paper strip 12.

To actuate sequential feeding of fanfold paper along the above described paper strip feed path A and to effect precision positioning of each individual strip 12, a controller 40, such as a mechanical timing device or integrated electronic control, is provided in accordance with this invention. The controller 40 functions to time an operational interval for feeding a paper strip 12 into position at rotary cutter 28.

The controller 40 establishes to the predetermined length of paper fed into apparatus 10 to provide the proper placement of cuts adjacent fanfolds. Control means 40 intermittently actuates feed means and effects a dwell between advancing movements of paper strip 12. Feed means 14 operates to advance full strip lengths in timed synchonism to the controller 40 to equal counter clockwise rotation of rotary cutter 28 such that feed means 14 intermittantly engages successive lengths of paper strip 12 in uniform movements to advance to cutting position. It is to be understood that the specific control mechanism of this invention may be provided in a variety of different embodiments.

The cutting cycle operates with the rotary cutter 28 revolving at a constant speed driven by a conventional motor 42. The cutting action at each blade 30, 32 is accomplished over a small portion of the rotary cutter revolution, approximately 30 degrees, to enable spreading of the cutting over a short period of time. From the foregoing description, it will be understood that as the paper strip 12 emerges from slitter 26, it is fed into rotary cutter 28 until the controller 40 disengages sheet feed means 14 to stop fanfold portion of paper strip a short distance (0.050") from the non-rotatable blade 38. The first blade 30 rotates to make the first cut transversely of longitudinal sides of strip closely adjacent fanfold 13. The cutting period of the second blade 32 follows the first blade 30 by a short period of revolution, approximately 60 degrees. The 60 degree revolution enables sufficient advancement of paper strip 10 from one side of fanfold to the other. Second blade 32 severs paper strip 15 about 120 degrees from start of first cut and transversely along its longitudinal sides closely adjacent fanfold to form trimmed clean-cut edged paper strip. The remaining 240 degrees revolution of rotary cutter 28 is used to advance the paper a full page length for the next cuts closely adjacent next fanfold. Adjustment of the position of the cut is readily made before a production run during maching set-up from an initial fanfold location set point.

It has been determined that the amount of time required to make a double cut adjacent each side of fanfold using the double bladed rotary cutting has decreased to 0.1 seconds from the 0.325 seconds needed with conventional single bladed rotary cutters. The resulting decrease in time yields a 300 percent increase in trimmed edged paper output without the necessity to increase rotation speed of rotary cutter.

The above described embodiment of the paper cutting apparatus also includes a blade position sensor means 50, such as a photoelectric eye or electronic timer or distance measure, mounted on frame 36. Integration of controller 40 and sheet engaging feed means 14 is accomplished by inclusion of sensor means 50. Sensor means 50 improves the precision control, advancement and positioning of paper strip 12 in relation to the continuous operating mode of rotary cutter 28. Actuation means, not shown, may also be incorporated with sensor means 50 to initiate restart of paper feed cycle.

The above summary of operation does not describe certain details of the various control mechanisms located in the controller, sensor means and actuator means however, it is to be understood that a variety of different controls and circuts may be employed in accordance with conventional techniques to effect operation of the present invention.

FIG. 4 graphically illustrates the fanfold paper as it appears at any instant in the above described cycle of the paper cutting invention. The fanfold paper 12 has carrier strips 22 removed by slitters, while downstream the fanfold or perforation portion of the paper 15 and the slitted carrier strips 17 are removed by action of the cutter and non-rotatable blade. Cut portions of paper 15, 17 and 22 are directed to waste receptical, while final clean edged and ended cut sheet 19 is directed to stacker.

By virtue of the above described construction, it will be understood that paper cutting apparatus 10 of this invention is particularly designed to work with or without integration with computer printer and the like to separate paper strips of fanfold, perforated or the like paper. The described simplicity of the disclosed construction serves to insure a high degree of reliability under normal operating conditions providing exceptional performance with minimum down time and attendant service requirements.

As will be apparent to persons skilled in the art, various modifications, adaptations and variations of the foregoing specific disclosure can be made without departing from the teachings of this invention.

I claim:

1. For use with continuous fanfold paper in the form of a strip having spaced folds extending transversely of longitudinal side edges of the paper strip, an apparatus comprising a frame, sheet engaging feed means mounted on the frame for feeding the paper strip along a feed path, a rotary cutter disposed in the strip feed path downstream of the sheet engaging feed means and supported on the frame for rotation about an axis extending transversely of the feed path, the rotary cutter having first and second blades extending generally parallel to the rotational axis of the rotary cutter for successively cutting the paper strip transversely of its longitudinal side edges and adjacent opposite sides of each fold of the strip during each paper feed cycle, a third blade pivotally supported on the frame and extending transversely of the feed path to cooperate with the first and second blades of the rotary cutter, the third blade normally being positioned for engagement with the first and second blades of the rotary cutter for severing the strip on opposite sides of its folds in timed relation to advancing strip movements, and cam means mounted on the rotary cutter, the cam means being engageable with the third blade to displace it into disengaged relation to the rotary cutter during a strip advancing, noncutting portion of each paper feed cycle.

2. The apparatus of claim 1 further including selectively operable power means for intermittently actuating the sheet engaging feed means and for effecting a dwell between advancing movements of the strip, continuously operable drive means for driving the rotary cutter in a preselected angular direction in timed relation to the intermittently actuatable feed means to sever the strip along opposite sides of each of its folds during dwells between advancing strip movements.

3. The apparatus of claim 1 wherein the first and second blades are each mounted on the rotary cutter to extend in an arcuate path along its length, the projection of the first and second blades in cross section being at an angle at about 90°.

4. The apparatus of claim 1 further including sensor means for sensing the lengths of paper strip movement to determine when the paper strip is in position to be cut.

5. The apparatus of claim 4 further including actuation means responsive to said sensor means to initiate a subsequent paper feed cycle after a cut has been made.

* * * * *